US012589913B1

(12) United States Patent
Shvartsman

(10) Patent No.: US 12,589,913 B1
(45) Date of Patent: Mar. 31, 2026

(54) SELF-OPENING PLASTIC BAG

(71) Applicant: Vladislav Shvartsman, Montreal (CA)

(72) Inventor: Vladislav Shvartsman, Montreal (CA)

( * ) Notice: Subject to any disclaimer, the term of this patent is extended or adjusted under 35 U.S.C. 154(b) by 0 days.

(21) Appl. No.: 19/300,667

(22) Filed: Aug. 14, 2025

(51) Int. Cl.
*B65D 33/00* (2006.01)

(52) U.S. Cl.
CPC ..... *B65D 33/007* (2013.01); *B65D 33/002* (2013.01)

(58) Field of Classification Search
CPC ... B65D 33/001; B65D 33/002; B65D 33/007
USPC ..... 383/37
See application file for complete search history.

(56) References Cited

U.S. PATENT DOCUMENTS 4,849,090 A * 7/1989 Case ..... B65D 33/002 206/390
5,469,970 A * 11/1995 Li ..... B65D 33/001 206/554
5,816,027 A * 10/1998 Li ..... B65D 33/001 493/194

* cited by examiner

*Primary Examiner* — Nathan J Newhouse
*Assistant Examiner* — Nina K Attel

(57) ABSTRACT

A roll of plastic bags, wherein the action of tearing a bag off the roll opens each bag. The present invention interrupts or vitiates the static cling that prevents the bag from being opened without licking or moistening fingers. A small adhesive patch is glued on the perforation line between bags, spanning both bags on the roll. Tearing off a bag causes the patch to rip out a small portion of the bag's mouth. Static cling is interrupted, and the bag can be opened.

7 Claims, 3 Drawing Sheets

SELF-OPENING PLASTIC BAG

The present invention relates to a method of manufacturing rolls of plastic bags, wherein the action of tearing off a leading bag causes the following bag to open. This is useful for dog waste and produce bags, and eliminates the need to lick one's fingers to open the bag.

BACKGROUND

It is common for dog owners to struggle with dog waste bags that won't open. Most dog walkers purchase bags on a roll for economic and space-saving reasons. Static cling is the main force that keeps the bag from opening, but there are also forces such as a vacuum between the inner walls, molecular welding, and Van Der Waals forces at work. Usually, the dog owner has to lick their fingers to separate the bag's walls to force open the bag's mouth.

Licking fingers is not desirable when a finger's hygiene is questionable, or if the dog walker is wearing gloves. Sometimes time is of the essence if the dog relieves itself in a high-traffic area. The same problem applies to grocery bags available on a roll: the salubrity of the cart and environment can be questionable, and putting fingers into one's mouth is not recommended.

In most prior art, each bag can be torn off the roll of bags along perforation lines between bags, each perforation line separating the bottom of the leading bag and the mouth of the following bag (or vice versa). Rarely, rolls of bags are wound side to side, with a perforated line between their sides. This configuration will not be relevant to the present invention.

It would be immensely practical for bags to open automatically, triggered by the user's application of force in tearing the leading bag off the roll of bags, hence the present invention.

There is known U.S. Pat. No. 8,979,367 for SELF OPENING BAGS WITH ATTACHING FEATURES, wherein there is at least one attaching feature on a bag's exterior, basically a tacky material that deforms a spot near the mouth of the following bag once the leading bag is torn off the roll. The present invention is simpler, and works in a different way.

There is also known U.S. Pat. No. 3,979,050 for MULTIPLY FILM ARTICLES, wherein deformation of the bags' mouths is performed with a heating element, thus adding a 'pucker' to the edges of the bag's mouth once it is ready for use. This prior art solves the problem of bags that won't open without moist fingers, but its implementation is more complicated than the present invention. This prior art needs a heating element at 200 degrees F., and each bag has to stop for 0.5 seconds during winding onto a roll. In the present invention, the bags can be wound onto a roll without stopping.

SUMMARY OF THE INVENTION

Static cling is the enemy of the dog walker. Opening dog waste bags is perhaps the least enjoyable part of a dog walk, even worse than picking up what the dog left behind. The present invention deals a blow of brute force to static cling, mechanically causing vitiation or interruption of the cling every time a leading bag is torn off the roll.

In the preferred embodiment, a one-inch patch of adhesive tape (or similar adhesive material) is glued over the perforation separating two bags. The patch bridges both bags, namely the weld and bottom of one bag, and the mouth of another bag. The application of force necessary to tear one bag off the roll causes the patch to rip out a void from another bag's mouth, thus vitiating the cling forces. The patch's adhesive strength does not have to be very strong, since the application of force to the patch is a shear force, i.e. parallel to the plane of the patch as glued, rather than a normal or axial force, i.e. in a perpendicular direction from the patch, which may cause the patch to peel off without tearing a void in a bag.

Most commercially-available rolls of bags are wound up with the bag's bottom first. Once the leading bag is torn off, the patch rips out a small piece off the following bag's mouth, thus vitiating or interrupting the static cling, and the new leading bag is rendered easily openable without having to moisten one's fingers.

Even if the roll of bags has the bags starting with a bag's mouth first, this invention works in the reverse, i.e. the leading bag's mouth is torn by the patch (instead of the following bag's mouth). Manufacture of this new and improved bag will be very simple-somewhere along the production line, right before the bags are wound onto a spool, the manufacturer can retrofit a rotor to glue on patches in the right places.

DETAILED DESCRIPTION OF THE DRAWINGS

There are two ways to wind plastic bags into a roll: bottom-first, or mouth-first. Bags can be wound onto a physical spindle, or wound without a spindle. Bags are usually folded in half, but they can be folded into thirds as well. In the preferred embodiment, all references will be made to the bottom-first, bag folded in half configuration. However, the invention works equally well with the mouth-first method, except the void is torn on the leading bag instead of the following bag.

The present invention opens a following plastic bag once a leading plastic bag is torn off a roll of bags. This is achieved by gluing a patch of adhesive tape to bridge the transition between a leading and following bag, and the user's action of tearing a leading bag off the roll causes the patch to tear out a void out of the mouth of a following bag. Once a void has been torn out, the forces keeping the bag from opening are vitiated, and it is possible to pry the bag open without having to lick or moisten one's fingers.

Figure 1:
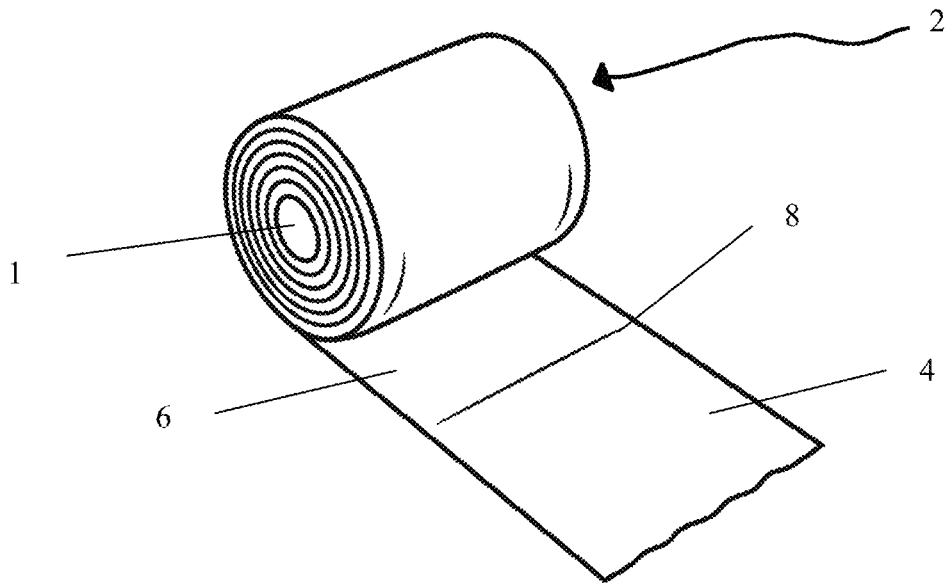
Figure 1 (Prior Art)
FIG. 1 shows a perspective view of a prior art roll of bags.

Referring now to Figures, FIG. 1 shows a typical roll of dog waste bags 2, wound bottom-first on spindle 1, with a leading bag 4 separated from following bag 6 by perforation 8. Perforation 8 not only helps to cleanly tear off the leading bag, but can also be characterized as the transition between bottom 24 of leading bag 4 and mouth edge 18 of following bag 6 (as seen on FIGS. 2 and 5).

Figure 2:
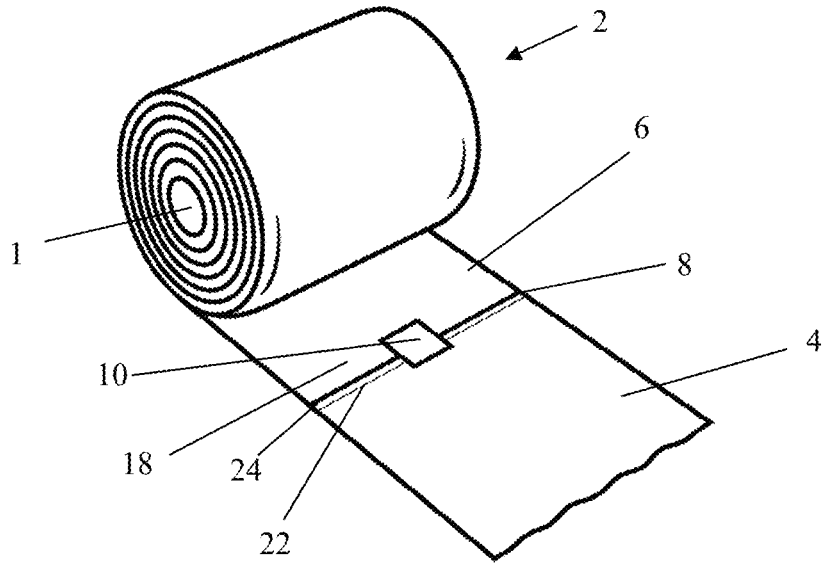
FIG. 2 shows a perspective view of the present invention's roll of bags on a spindle.

FIG. 2 shows the present invention, namely roll of bags 2 on spindle 1, with patch 10 located substantially in the middle of each perforation 8. As shown, patch 10 is simultaneously adhered to bag 4's weld 22, bottom 24, and to following bag 6's outside mouth edge 18. In the preferred embodiment, patch 10 is between 0.25" and 0.5" in length, thus it will cover bag 4's bottom 24's weld 22. Patch 10's covering of weld 22 assures that patch 10 will tear a void 12 out of outside mouth edge 18 of following bag 6, since mouth edge 18's structural integrity is far weaker than bottom 24's weld 22. This is because mouth edge 18 is a single ply, and weld 22 creates a fused two-ply structure.

Figure 3:
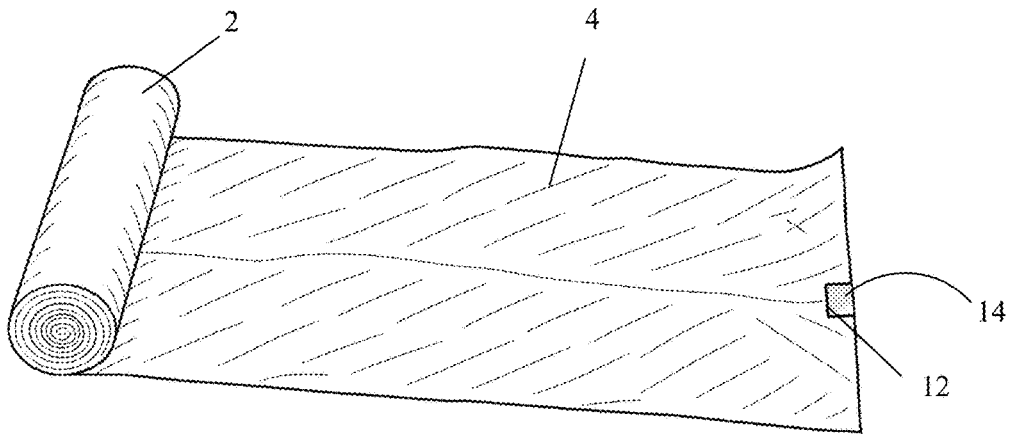
FIG. 3 shows a folded leading bag on a roll of bags with a void removed by the previous bag.

FIG. 3 demonstrates a formerly following bag 6, now the new leading bag 4, after the previous leading bag 4 had been torn off spindle-less roll 2. Void 12 is formed by removal of patch 10 at the moment previous leading bag 4 was torn off, and grab access 14 is available on the inside mouth edge 16 of leading bag 4. Void 12 is the same shape as patch 10's footprint on outside mouth edge 18. Void 12 interrupts or vitiates the static cling preventing inside mouth edge 16 from easily opening.

Figure 4:
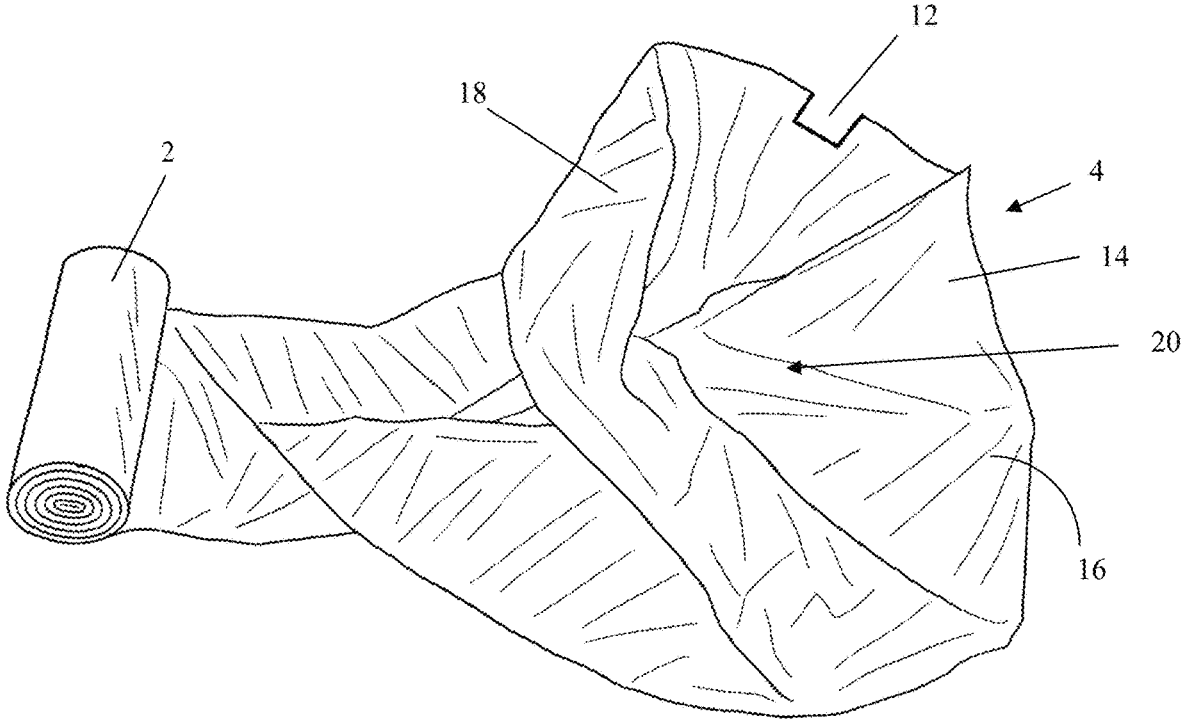
FIG. 4 shows an open, unfolded leading bag on a roll of bags with a void removed by the previous bag.

FIG. 4 shows leading bag 4 of FIG. 3 in a fully unfolded and open configuration. Through void 12, user pinches inside mouth edge 16 and outside mouth edge 18 via grab access 14 and can easily pry apart inside mouth edge 16 to open bag 4 and gain access to bag 4's mouth 20.

Figure 5:
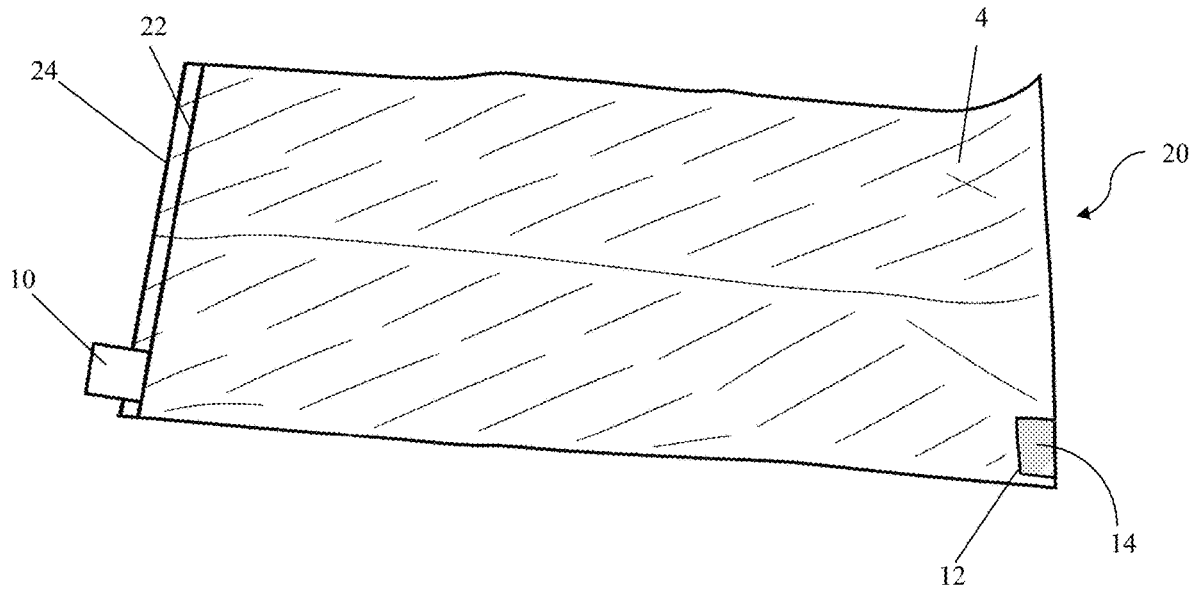
FIG. 5 shows an unfolded, unopened bag, after being torn off a roll of bags.

FIG. 5 shows bag 4 after having been torn off roll 2 and unfolded, but not opened. Patch 10 remains on weld 22 and bottom 24 of bag 4, and bag 4's mouth 20 comprises a void 12 that was torn out by a previous patch 10. Grab access 14 permits the user to open bag 4 because the static cling was vitiated or interrupted by a previous patch 10's removal of a small part of bag 4's mouth.

In prototyping stage, it was found that patch 10 will always remain stuck to weld 22 and never stuck to outside mouth edge 18 due to the aforementioned superior structural integrity of weld 22 versus inferior structural integrity of mouth edge 18. This feature allows the user to locate bag 4's mouth 20 a lot easier since mouth 20 will always be on the end opposite to patch 10. In the preferred embodiment, patch 10 is adhered as shown on FIG. 2, namely in the center of the width of perforation 8. However, patch 10 can be adhered at any point on perforation 8, and will render the same vitiation function.

The preceding detailed description discloses a preferred embodiment of the present invention, wherein bags are rolled bottom-first onto a spindle, bags are folded in half, and adhesive patch 10 is adhesive cellophane tape. However, it should be noted that the present invention will work in any other conceivable configuration, for dog waste or produce bags, and adhesive patch 10 can be made of any material that is strong enough to tear a void 12 out of outside mouth edge 18 upon tearing of bag 4 off roll 2. Patch 10 can be made of various materials, such as plastic, fabric, or paper.

The invention claimed is:

1. A roll of self-opening bags, comprising:

a plurality of identical plastic bags wound into the roll, each said bag of said plurality of plastic bags comprising:

a length and a width, a bottom portion, wherein said bottom portion comprises a weld across said width perpendicular to said length, and a top portion, wherein said top portion comprises a mouth adapted to be opened, wherein each of said bags of said plurality of plastic bags are separated by a perforation line, said perforation line being located between said bottom portion of one said bag of said plurality of plastic bags and said top portion of an immediately-subsequent said bag of said plurality of plastic bags, wherein said perforation line facilitates a removal of said one said bag from said immediately-subsequent said bag, and an adhesive patch with a length and a width, adhered onto said perforation line, said adhesive patch adhered simultaneously to said weld of said one said bag and said mouth of said immediately-subsequent said bag, wherein said removal of said one said bag from said immediately-subsequent said bag causes said adhesive patch to tear out a part of said mouth of said immediately-subsequent said bag, thereby disrupting cling forces preventing said mouth from opening.

2. The roll of self-opening bags according to claim 1, wherein said roll of self-opening bags is wound onto a spindle.

3. The roll of self-opening bags according to claim 1, wherein said roll of self-opening bags is wound without a spindle.

4. The roll of self-opening bags according to claim 1, wherein said adhesive patch comprises cellophane tape.

5. The roll of self-opening bags according to claim 1, wherein said adhesive patch comprises fabric tape.

6. The roll of self-opening bags according to claim 1, wherein said adhesive patch comprises paper tape.

7. The roll of self-opening bags according to claim 1, wherein said adhesive patch's length is at least 0.5", and said adhesive patch's width is at least 0.25".

* * * * *